United States Patent [19]

Naylor et al.

[11] Patent Number: 4,704,858

[45] Date of Patent: Nov. 10, 1987

[54] FALSE TWISTING APPARATUS

[75] Inventors: Geoffrey Naylor, Macclesfield; Philip M. Wilkinson, Cheadle, both of England

[73] Assignee: Rieter Scragg Limited, Cheshire, England

[21] Appl. No.: 914,279

[22] Filed: Oct. 2, 1986

[30] Foreign Application Priority Data

Oct. 10, 1985 [GB] United Kingdom ..... 8525048

[51] Int. Cl.[4] ..... D02G 1/04; D02G 1/08

[52] U.S. Cl. ..... 57/340; 57/339; 57/348

[58] Field of Search ..... 57/334, 337–340, 57/348

[56] References Cited

U.S. PATENT DOCUMENTS

| | | | |
|---|---|---|---|
| 3,885,378 | 5/1975 | Schuster | 57/339 |
| 4,060,967 | 12/1977 | Lorenz | 57/339 X |
| 4,110,962 | 9/1978 | Schuster et al. | 57/339 |
| 4,134,252 | 1/1979 | Otaki et al. | 57/348 X |
| 4,240,248 | 12/1980 | Raschle | 57/338 |
| 4,485,617 | 12/1984 | Schmitt et al. | 57/340 |
| 4,584,831 | 4/1986 | Schuster et al. | 57/348 X |

FOREIGN PATENT DOCUMENTS

| | | |
|---|---|---|
| 1379960 | 1/1975 | United Kingdom . |
| 1381132 | 1/1975 | United Kingdom . |
| 1419085 | 12/1975 | United Kingdom . |
| 1419086 | 12/1975 | United Kingdom . |
| 1419087 | 12/1975 | United Kingdom . |
| 1437464 | 5/1976 | United Kingdom . |
| 1456655 | 11/1976 | United Kingdom . |
| 1475698 | 6/1977 | United Kingdom . |
| 2121076 | 12/1983 | United Kingdom . |

*Primary Examiner*—John Petrakes

*Attorney, Agent, or Firm*—Oblon, Fisher, Spivak, McClelland & Maier

[57] ABSTRACT

Apparatus for false twisting yarns is of the type comprising three rotatable shafts, each shaft having a plurality of discs thereon. The shafts are mounted on a base member and two shafts are pivotal about axes which with the axis of the third shaft are at the apices of an equilateral triangle. The third shaft, and spindles providing pivots for the movable arms which carry the other shafts, each have a respective first drive pulley thereon and a primary drive belt passes around the three pulleys. The spindles each also have second drive pulley thereon and each movable shaft has a third drive pulley thereon, a second drive belt passing around each respective pair of second and third drive pulleys. A cam mounted on the third shaft has two like operating portions into contact with which a respective follower part of each movable shaft is biassed. Movement of the shafts may be made without alteration of the tension in, or reverse bending of, the belts.

18 Claims, 4 Drawing Figures

FALSE TWISTING APPARATUS

BACKGROUND OF THE INVENTION AND DESCRIPTION OF THE PRIOR ART

This invention relates to apparatus for false twisting yarns, and in particular to apparatus of the type comprising three rotatable, parallel shafts located at the apices of an equilateral triangle, a plurality of parallel coaxial discs forming a disc stack carried by each shaft, the discs being arranged on the shafts so as to create a series of overlapping discs arranged on a helix around a line parallel with the shafts and centrally thereof. Such apparatus is well known and is described in, for example, U.K. Pat. Nos. 1379960, 1381132, 1419085, 1419086, 1419087, 1437464, 1456655, 1475698 and 2121076. The amount of overlap of the discs plays an important part in determining the level of twist which is imparted to a yarn as it passes through the apparatus and is false twisted by contact with the disc peripheries. U.K. Pat. Nos. 1379960, 1419085 and 1437464 describe arrangements whereby the spacing of the shafts may be adjusted whilst remaining equiangularly spaced. With such arrangements the shafts are driven by means of a drive belt which passes around a drive pulley and a wharve or pulley provided on each shaft. In order to accommodate the variable shaft spacing, the drive belt also passes around a belt-tensioning "jockey-wheel" mounted on a resiliently biassed pivotal arm. This arrangement leads to a variation in belt tension between opposite ends of the adjustment range and hence possibly to unsatisfactory drive transmission, undue belt stretching and/or premature belt failure. Furthermore such arrangements usually involve reverse bending of the drive belt, which also contributes to the shortening of belt life and to excessive consumption of power.

It is an object of the present invention to provide an apparatus of the abovementioned type which avoids the abovementioned disadvantages or is subject thereto to a lesser extent.

SUMMARY OF THE INVENTION

The invention provides apparatus for false twisting yarns comprising; three rotatable shafts, each shaft having a plurality of discs thereon, the shafts being mounted on a base member and being movable relative to each other whilst maintaining a mutally parallel, equilaterally spaced relative disposition; wherein each movable shaft is mounted on said base member so as to be pivotal about a respective axis located at an apex of an equilateral triangle, the apparatus also comprising three first drive pulleys each being mounted on said base member for rotation about a respective one of said axes, a primary drive belt passing around said first drive pulleys, and for each movable shaft a respective second drive pulley mounted for rotation with a first drive pulley about a respective axis, a third drive pulley mounted on said each movable shaft and a respective secondary drive belt passing around said second and third drive pulleys.

Preferably two shafts are movable relative to said base member and the third shaft, which third shaft is mounted on said base member for rotation about one of said axes fixedly located therein.

The apparatus may also comprise a cam disposed to contact a follower portion of each movable shaft and be movable to move each movable shaft through an equal angular displacement. The cam may be mounted on said third shaft so as to be rotatable about the axis thereof, the cam having two like profiled operating portions, each in contact with said follower portion of one movable shaft. Biasing means may be provided, operable to bias each movable shaft into contact with said cam.

One of said movable shafts may be pivotal through an angular displacement to a threading location in which the discs on said one shaft do not overlap the discs on the other shafts. Preferably said biasing means is operable to bias said one shaft towards said threading location when it is adjacent thereto, and away from said threading location and into contact with said cam when it is in a position remote from said threading location.

BRIEF DESCRIPTION OF THE DRAWINGS

One embodiment of apparatus in accordance with the invention will now be described with reference to the accompanying drawings in which.

DETAILED DESCRIPTION OF THE PREFERRED EMBODIMENT

Figure 1:
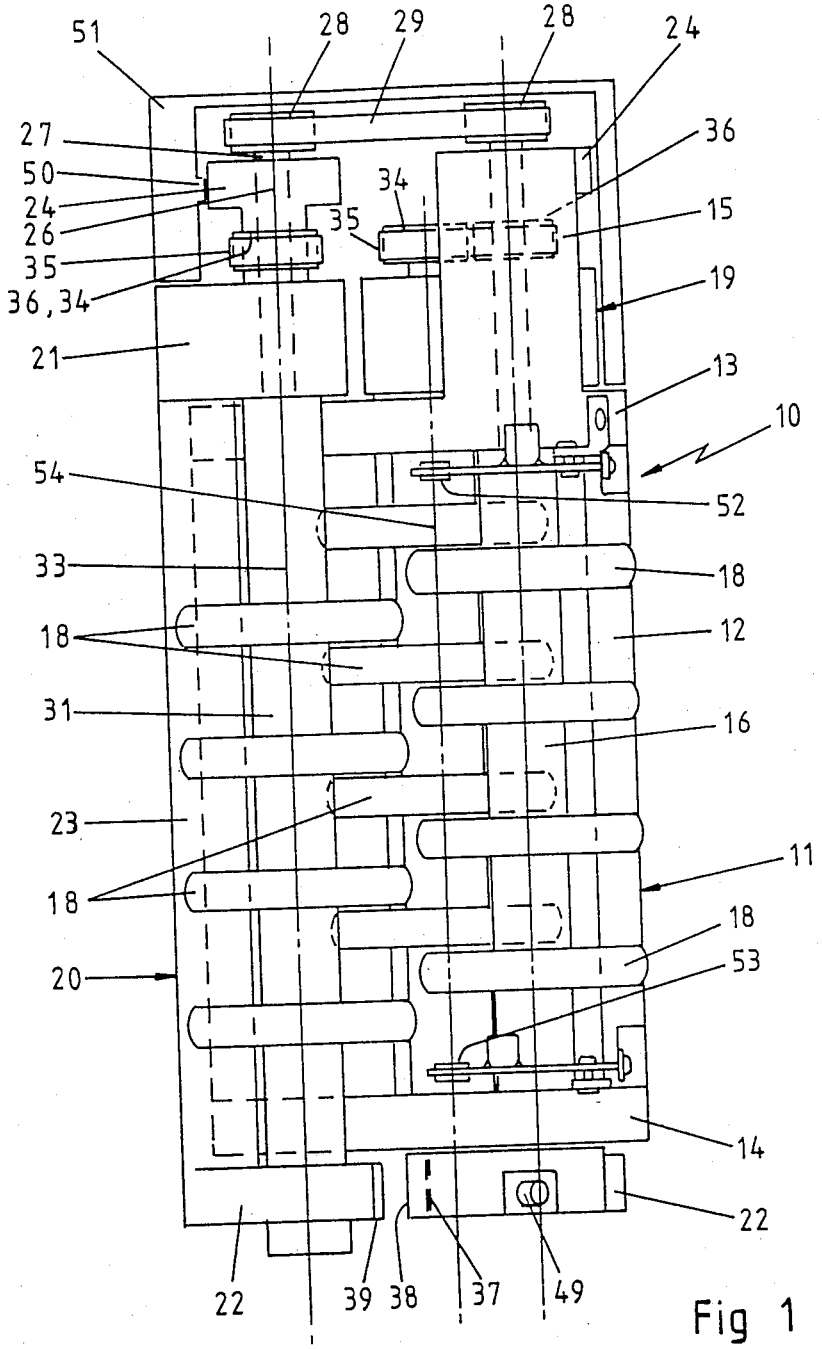
FIG. 1 is a front elevation

Referring now to the figures there is shown an apparatus 10 for false twisting a yarn, comprising a base member 11 of which there is an upstanding pillar 12, upper and lower base plates 13, 14 and an upper boss 15. Bearings (not shown) located in upper and lower base plates 13, 14 mount a third shaft 16, which is rotatable about a fixed axis 17 and on which are a plurality of discs 18 axially spaced therealong.

Mounted on the upper and lower plates 13, 14 of base member 11 are two movable arms 19, 20, each comprising an upper and lower arm plate 21, 22, a spine 23 extending therebetween and and upper boss 24. The arms 19, 20 are mounted so as to be pivotal about respective axes 25, 26, which with axis 17, are fixedly located in the base member 11 at the apices of an equilateral triangle. A respective spindle 27, rotatable about axis 25 or 26, provides the pivotal mounting for arm 19 or 20 and carries a first drive pulley 28. Another first drive pulley 28 is provided on the third shaft 16 and a primary drive belt 29 passes around the three first drive pulleys 28. Spindles 27 also carry a respective second drive pulley 36.

Mounted in the upper and lower plates 21, 22 of each movable arm 19, 20 are first and second movable shafts 30, 31 respectively, which are rotatable about axes 32, 33 respectively. On shafts 30, 31 are third drive pulleys 34, and a secondary drive belt 35 passes around each respective pair of second and third drive pulleys 36, 34. Shafts 30, 31 also carry a plurality of discs 18, the axial spacing of which is such that the disc 18 on the three shafts 16, 30, 31 overlap each other and are disposed in sequence from top to bottom of the apparatus 10 on a helix around a line parellel with axes 17, 25, 26, 32, and 33.

Figure 2:
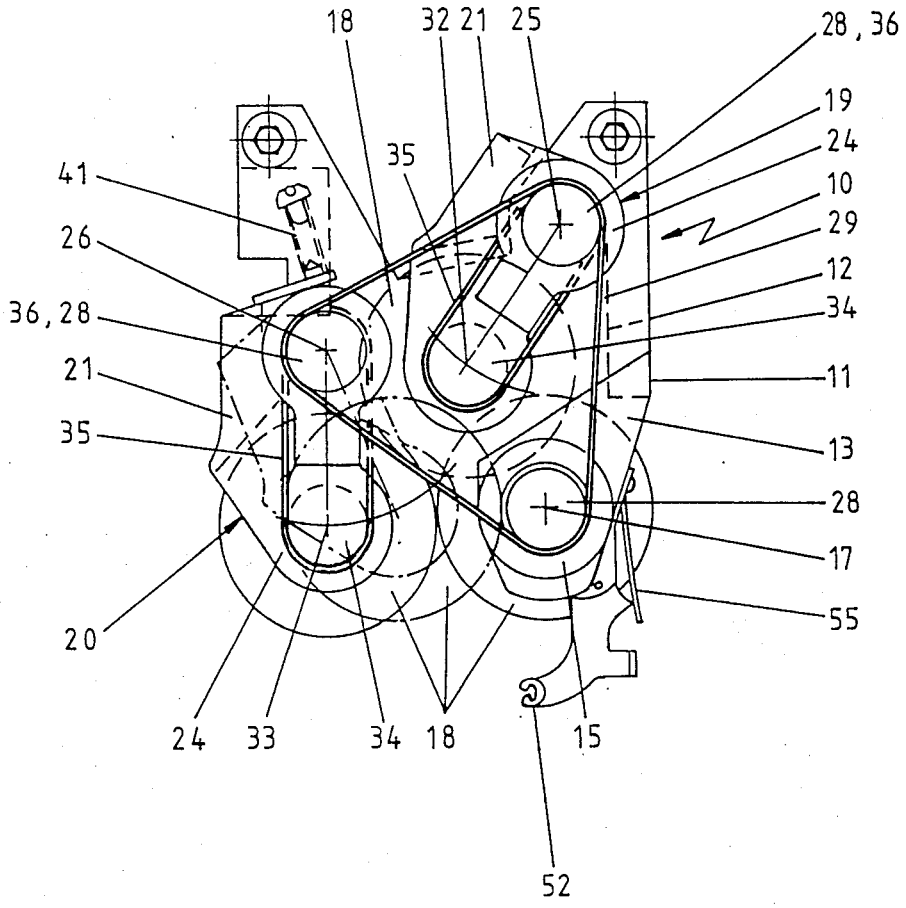
FIG. 2 is a plan view, showing the drive arrangement.
Figure 3:
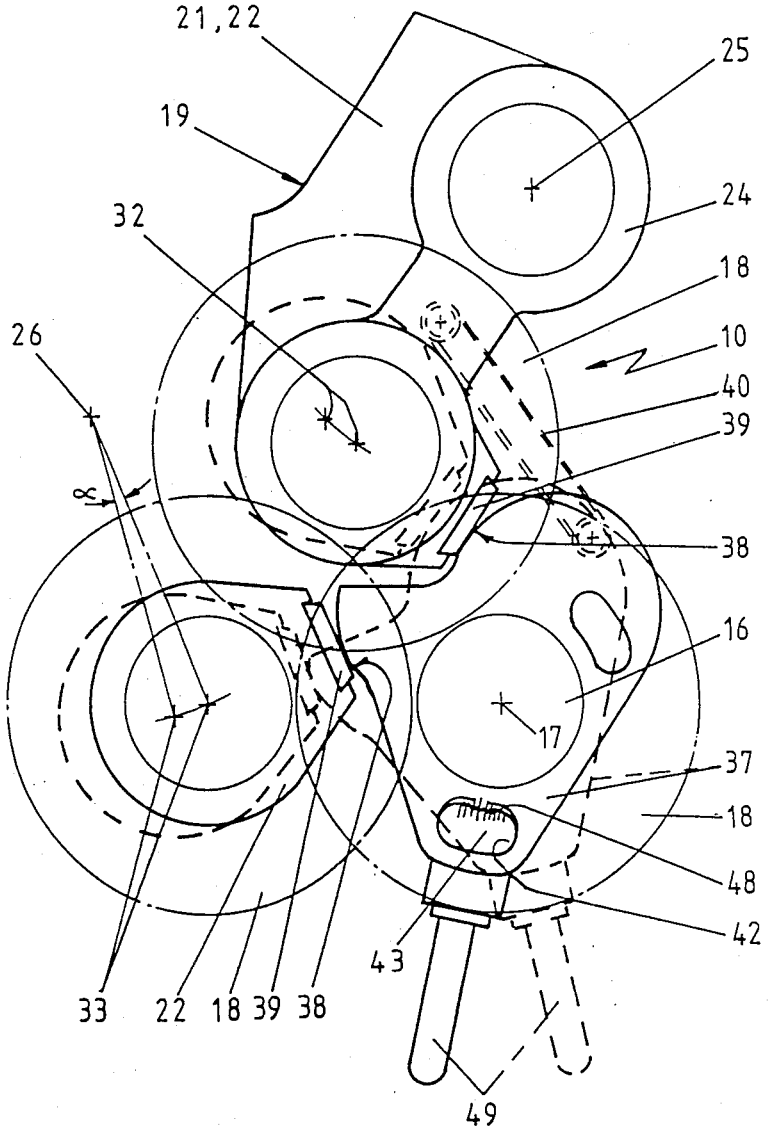
FIG. 3 is a second plan view, showing the cam arrangement.

Referring now in particular to FIG. 3 it may be seen that a cam 37 is provided on shaft 16 and has two identically profiled operating portions 38, each of which is contacted by a follower portion 39 of a movable arm 19, 20. A tension spring 40 extends between movable arm 19 and the cam 37 so as to bias the arm 19 into contact with the cam 37. A compression spring 41 (see FIG. 2) extends between movable arm 20 and the lower plate 14 of base member 11 so as to bias the arm 20 into contact with the cam 37. Rotation of the cam 37 about axis 17 causes arms 19, 20 to pivot about their respective pivot axes 25, 26 by equal amounts so that the shaft axes 17, 32, 33 remain at the apices of an equilateral triangle. A slot 42 in cam 37 is provided with graduations 43 adjacent thereto so that when the cam 37 is rotated using the handle 49 the overlap of the discs 18 can be adjusted as required to produce the requisite twist level in the yarn to be false twisted. In addition a clamp bolt (not shown) may be provided on the lower plate 14 to contact the cam 37, and notches or detents 48 are provided on the cam 37 to secure and/or locate the cam 37 in the desired position. Throughout such movement of the arms 19, 20 the length of the drive belts 29, 35 is not changed and the tensions therein remain constant. In addition there is no reverse twisting of a drive belt so that long life and minimum power consumption are achieved.

In order to thread a yarn into the apparatus 10 the arm 20 may be moved manually out of contact with the cam 37 to the threading location shown in FIGS. 1 and 2. In this position the discs 18 on shaft 31 do not overlap the discs 18 on shaft 16 and a yarn can be readily introduced therebetween. Again on stretching of the drive belts 29, 35 is involved. In this position the line of action of compression spring 41 is to the opposite side of the axis 26 about which arm 20 pivots from that when the arm 20 is in a normal operating position. In this way the spring 41 biases the arm 20 towards the threading location when it is adjacent thereto and away from the threading position and into contact with the cam 37 when it is in an operating position remote from the threading location. A stop 50 is provided on a cover 51 of the apparatus 10 to locate the arm 20 in this threading position. To facilitate threading input and output yarn guides 52, 53 are provided, pivotally mounted on the upper and lower plates 13, 14 respectively. In FIG. 1 the yarn guides 52, 53 are shown in the operating position and lying on the central axis 54 of the apparatus 10 adjacent the endmost discs 18. The guides 52, 53 may be pivoted outwardly against the action of a leaf spring 55 to a thread-up position as shown in FIG. 2 wherein the guides 52, 53 are outside the envelope of the discs 18. The guides 52, 53, after the yarn has been introduced thereinto, may then be pivoted back to the operating position of FIG. 1 to form input and output guides for the unit 10 and the arm 20 moved inwardly to its operating position in contact with cam 37. The guides 52, 53 may be moved individually or may be coupled for simultaneous movement as desired.

Figure 4:
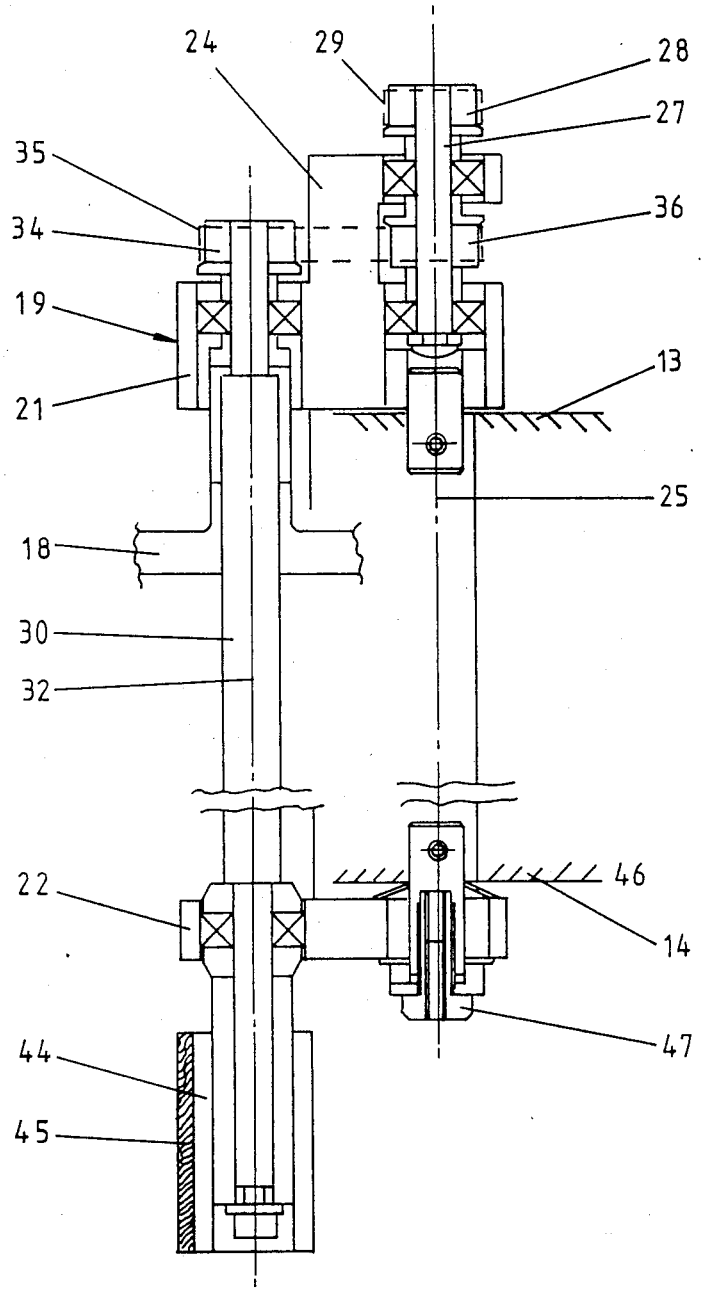
FIG. 4 is a sectional elevation of one movable spindle mounting arrangement.

A wharve 44 (see FIG. 4) is provided on the lower end of shaft 30 so that the apparatus 10 can be driven by a machine drive belt 45. The drive then passes from third drive pulley 34 mounted on shaft 30, through the secondary drive belt 35 passing therearound to the second drive pulley 36 on spindle 27, from the first drive pulley 28 on spindle 27 through the primary drive belt 29 to the other first drive pulleys 28 and finally from second drive pulley 36 on the other spindle 37 through the other secondary drive belt 35 to the third drive pulley 34 on spindle 31. To adjust the axial spacing of the discs 18 on one shaft from those on another resilient cupwasher 46 are located between the lower plate 14 of base member 11 and lower plate 22 of movable arm 19 or 20. A screw 47 is provided in an axial bore in the spindle 27, the head of which screw bears against the lower plate 22. By adjustment of screw 47 and the subsequent compression of the spring washers 46 the axial location of the movable arm 19 or 20 and hence the discs 18 on spindle 30 or 31 mounted therein may be adjusted as required.

If the cover 51 is removed the stop 50 is no longer operative so that the arm 20 may be pivoted outwardly to a greater extent than is shown in FIGS. 1 and 2. This enables access to the interior of the apparatus 10 to be gained for maintenance purposes.

We claim:

1. Apparatus for false twisting yarns comprising three rotatable shafts, a plurality of discs mounted on each shaft, a base member having three axes located therein at the apices of an equilateral triangle and on which base member said shafts are mounted, shaft mounting means operable to allow relative movement of said shafts relative to each other whilst maintaining a mutually parallel, equilaterally spaced relative disposition, said mounting means including pivoting means whereby each movable shaft is mounted on said base member so as to be pivotal about a respective one of said axes, the apparatus also comprising three first drive pulleys each being mounted on said base member for rotation about a respective one of said axes, a primary drive belt passing around said first drive pulleys, and for each movable shaft a second drive pulley mounted for rotation with a first drive pulley about a respective axis, a third drive pulley mounted on said each movable shaft and a respective secondary drive belt passing around said second and third drive pulleys.

2. Apparatus according to claim 1 comprising a cam disposed to contact a follower portion of each movable shaft and operable to move each movable shaft through an equal angular displacement.

3. Apparatus according to claim 2 wherein two shafts are movable relative to said base member and the third shaft, which third shaft is mounted on said base member for rotation about one of said axes fixedly located therein.

4. Apparatus according to claim 3 wherein said cam is mounted on said third shaft so as to be rotatable about the axis thereof, each movable shaft having a follower portion and said cam having two like profiled operating portions, each of said operating portions being in contact with said follower portion of one movable shaft.

5. Apparatus according to claim 4 comprising biasing means operable to bias each movable shaft into contact with said cam.

6. Apparatus according to claim 5 wherein one of said movable shafts is pivotal through an angular displacement to a threading location in which the discs on said one movable shaft do not overlap the discs on at least one other of said shafts.

7. Apparatus according to claim 6 wherein said biasing means is operable to bias said one movable shaft towards said threading location when it is adjacent thereto, and away from said threading location and into contact with said cam when it is in a position remote from said threading location.

8. Apparatus according to claim 7 comprising cover means in which said drive pulleys and said drive belts are located.

9. Apparatus according to claim 8 wherein said cover means comprise stop means adapted to locate said one movable shaft in said threading location when said one movable shaft is moved into contact with said stop means.

10. Apparatus according to claim 9 wherein said one movable shaft is movable beyond said threading position to an apparatus maintenance position when said cover is removed.

11. Apparatus according to claim 3 wherein said base member comprises upper and lower base plates, an upstanding pillar extending therebetween, and an upper boss.

12. Apparatus according to claim 11 comprising bearings located in said upper and lower base plates, wherein said third shaft is mounted in said bearings to rotate about said one axis.

13. Apparatus according to claim 12 wherein two movable arms are mounted on said upper and lower base plates so as to be pivotal about the other two of said axes.

14. Apparatus according to claim 13 wherein each arm comprises an upper and lower arm plate, a spine extending therebetween and an upper boss.

15. Apparatus according to claim 14 comprising a respective spindle for each movable arm, each spindle having respective said first and second drive pulleys thereon and providing a pivotal mounting for said arm.

16. Apparatus according to claim 15 wherein each movable shaft is mounted in said upper and lower arm plates of a respective movable arm.

17. Apparatus according to claim 3 wherein one of said cam and said base member has graduations marked thereon whereby the overlap of said discs on said shafts may be adjusted as required.

18. Apparatus according to claim 3 wherein one of said cam and said base member has detents therein contacted by the other, whereby the overlap of said discs on said shafts may be adjusted as required.

* * * * *